US007425127B2

(12) United States Patent
Zinn et al.

(10) Patent No.: US 7,425,127 B2
(45) Date of Patent: Sep. 16, 2008

(54) STAGNATION POINT REVERSE FLOW COMBUSTOR

(75) Inventors: Ben T. Zinn, Atlanta, GA (US); Yedidia Neumeier, Atlanta, GA (US); Jerry M. Seitzman, Atlanta, GA (US); Jechiel Jagoda, Atlanta, GA (US); Yoav Weksler, Haifa (IL)

(73) Assignee: Georgia Tech Research Corporation, Atlanta, GA (US)

( * ) Notice: Subject to any disclaimer, the term of this patent is extended or adjusted under 35 U.S.C. 154(b) by 0 days.

(21) Appl. No.: 10/927,205

(22) Filed: Aug. 26, 2004

(65) Prior Publication Data

US 2005/0277074 A1 Dec. 15, 2005

Related U.S. Application Data

(60) Provisional application No. 60/578,554, filed on Jun. 10, 2004.

(51) Int. Cl.
*F23M 3/00* (2006.01)

(52) U.S. Cl. ..... 431/9; 431/116; 431/115; 431/171

(58) Field of Classification Search ..... 431/8, 431/9, 115, 116, 159, 171, 215
See application file for complete search history.

(56) References Cited

U.S. PATENT DOCUMENTS 281,590 A * 7/1883 Wenham ..... 431/215
282,337 A * 7/1883 Lipsey ..... 431/215
299,660 A * 6/1884 Lipsey ..... 431/215
331,261 A * 11/1885 Stuertz ..... 431/215
406,659 A * 7/1889 Mason ..... 431/171
429,398 A * 6/1890 Westphal ..... 431/215
435,670 A * 9/1890 Stellwag ..... 431/215
570,450 A * 11/1896 Bradley ..... 431/163

(Continued)

FOREIGN PATENT DOCUMENTS

DE 3502662 A1 * 7/1986

(Continued)

OTHER PUBLICATIONS

"Laseroptical Investigation of Highly Preheated Combustion with Strong Exhaust Gas Recirculation;"Twenty-Seventh Symposium (International) on Combustion/The Combustion Institute, Aug. 1998, pp. 3197-3204; Tobias Plessing, Norbert Peters, and Joachim G. Wunning.

(Continued)

*Primary Examiner*—Alfred Basichas
(74) *Attorney, Agent, or Firm*—Bockhop & Associates, LLC; Bryan W. Bockhop

(57) ABSTRACT

A method for combusting a combustible fuel includes providing a vessel having an opening near a proximate end and a closed distal end defining a combustion chamber. A combustible reactants mixture is presented into the combustion chamber. The combustible reactants mixture is ignited creating a flame and combustion products. The closed end of the combustion chamber is utilized for directing combustion products toward the opening of the combustion chamber creating a reverse flow of combustion products within the combustion chamber. The reverse flow of combustion products is intermixed with combustible reactants mixture to maintain the flame.

12 Claims, 11 Drawing Sheets

U.S. PATENT DOCUMENTS

| | | | | | |
|---|---|---|---|---|---|
| 1,284,182 | A | * | 11/1918 | Doble | 431/9 |
| 1,349,971 | A | * | 8/1920 | McDonald | 431/171 |
| 1,474,867 | A | * | 11/1923 | Walker | 431/187 |
| 1,614,085 | A | * | 1/1927 | Runyan | 432/159 |
| 2,275,678 | A | * | 3/1942 | Mason | 431/238 |
| 2,287,246 | A | * | 6/1942 | Hess | 431/348 |
| 2,800,175 | A | * | 7/1957 | Sharp | 431/9 |
| 2,876,831 | A | * | 3/1959 | Knight | 431/158 |
| 3,096,812 | A | * | 7/1963 | Kervin | 431/158 |
| 3,285,840 | A | | 11/1966 | Lindemann | |
| 3,309,866 | A | | 3/1967 | Kydd | |
| 3,407,596 | A | * | 10/1968 | Dasbach et al. | 60/737 |
| 3,843,307 | A | | 10/1974 | Staudinger | |
| 4,040,252 | A | * | 8/1977 | Mosier et al. | 60/804 |
| 4,284,402 | A | * | 8/1981 | Sheets et al. | 431/9 |
| 4,298,333 | A | | 11/1981 | Wunning | |
| 4,306,858 | A | | 12/1981 | Simon | |
| 4,549,402 | A | | 10/1985 | Saintsbury et al. | |
| 4,551,089 | A | * | 11/1985 | Miyahara | 431/116 |
| 4,586,894 | A | | 5/1986 | Wunning | |
| 4,877,396 | A | | 10/1989 | Wunning | |
| 4,926,765 | A | * | 5/1990 | Dreizler et al. | 110/234 |
| 5,044,932 | A | | 9/1991 | Martin et al. | |
| 5,154,599 | A | | 10/1992 | Wunning | |
| 5,201,650 | A | * | 4/1993 | Johnson | 431/9 |
| 5,203,690 | A | * | 4/1993 | Maruko | 431/236 |
| 5,216,885 | A | | 6/1993 | Taniguchi | |
| 5,255,742 | A | | 10/1993 | Mikus | |
| 5,295,354 | A | | 3/1994 | Barbier | |
| 5,404,952 | A | | 4/1995 | Vinegar et al. | |
| 5,501,162 | A | * | 3/1996 | Kravets | 110/347 |
| 5,515,680 | A | | 5/1996 | Fujimura et al. | |
| 5,570,679 | A | | 11/1996 | Wunning | |
| 5,623,819 | A | | 4/1997 | Bowker | |
| 5,862,858 | A | | 1/1999 | Wellington et al. | |
| 5,899,269 | A | | 5/1999 | Wellington et al. | |
| 6,019,172 | A | | 2/2000 | Wellington et al. | |
| 6,033,207 | A | | 3/2000 | Cummings | |
| 6,038,854 | A | | 3/2000 | Penetrante | |
| 6,042,371 | A | * | 3/2000 | Mitani et al. | 432/179 |
| 6,047,550 | A | | 4/2000 | Beebe | |
| 6,174,160 | B1 | | 1/2001 | Lee et al. | |
| 6,269,882 | B1 | | 8/2001 | Wellington et al. | |
| 6,321,743 | B1 | * | 11/2001 | Khinkis et al. | 126/91 A |
| 6,345,495 | B1 | | 2/2002 | Cummings | |
| 6,485,289 | B1 | * | 11/2002 | Kelly et al. | 431/4 |
| 6,594,999 | B2 | | 7/2003 | Mandai | |
| 6,599,119 | B1 | | 7/2003 | Wood et al. | |
| 6,752,620 | B2 | | 6/2004 | Heier et al. | |
| 6,796,789 | B1 | | 9/2004 | Gibson et al. | |
| 6,886,341 | B2 | | 5/2005 | Inoue | |
| 7,250,151 | B2 | | 7/2007 | Tonkovich | |
| 2002/0069648 | A1 | | 6/2002 | Levy et al. | |
| 2002/0181245 | A1 | | 12/2002 | Futschik et al. | |

FOREIGN PATENT DOCUMENTS

| | | | | |
|---|---|---|---|---|
| DE | 3738623 | C | * | 2/1989 |
| EP | 0698764 | | | 2/1996 |
| EP | 0725.251 | | | 8/1996 |
| EP | 1355 111 | | | 10/2003 |
| GB | 100072 | | | 4/1917 |
| GB | 997420 | | | 7/1965 |
| GB | 1065282 | | | 4/1967 |
| GB | 1146400 | | | 3/1969 |
| JP | 2003279001 | A | * | 10/2003 |
| NZ | 503462 | | | 9/2001 |
| WO | WO 03/091626 | | | 11/2003 |

OTHER PUBLICATIONS

"NOx Behavior in Lean-Premixed Combustion;" Twenty-Seventh Symposium (International) on Combustion, Presented at the University of Colorado at Boulder; Aug. 1998, pp. 1-11; Teodora Rutar Shuman, David G. Nicol, John C.Y. Lee and Philip C. Malte.

Rutar, et al., "NOx Dependency on Residence Time and Inlet Temperature for Lean-Premixed Combustion in Jet-Stirred Reactors," ASME Paper No. 98-GT-433, 43rd International Gas Turbine and Aeroengine Congress, Stockholm, Sweden (1998).

Shuman, "NOx and CO Formation for Lean-Premixed Methane-Air Combustion in a Jet-Stirred Reactor Operated at Elevated Pressure," dissertation submitted to the University of Washington, 2000.

* cited by examiner

STAGNATION POINT REVERSE FLOW COMBUSTOR

BENEFIT CLAIMS TO PRIOR APPLICATIONS

This application claims the benefit of U.S. Provisional Application No. 60/578,554 filed on Jun. 10, 2004.

GOVERNMENT INTERESTS

This invention was made in part during work supported by the U.S. Government, including grants from the National Aeronautics and Space Administration (NASA), #NCC3-982. The government may have certain rights in the invention.

FIELD OF THE INVENTION

This invention relates to combustion systems in general and more particularly to a combustion system which utilizes a combustion chamber design for low pollutant emissions by creating a stagnation point for anchoring a flame and reverse flow of combustion products that partially mixes with the incoming reactants.

BACKGROUND

Combustion and its control are essential features to everyday life. Approximately eighty-five percent of the energy used in the United States alone is derived via combustion processes. Combustion of combustible resources is utilized for, among other things, transportation, heat and power. However, with the prevalent occurrences of combustion, one of the major downsides of these processes is environmental pollution. In particular, the major pollutants produced are nitrogen oxides (NOx), carbon monoxide (CO), unburned hydrocarbons (UHC), soot and sulfur dioxides. Emissions of NOx in particular, have exceeded over twenty-five million short tons in preceding years. Such pollutants have raised public concerns.

In response to public concerns, governments have initiated laws regulating the emission of pollutants. As a result, current combustion systems must efficiently convert the fuel energy into heat with low emissions of NOx, CO, UHC, and soot.

To burn, the fuel must first mix with an oxidant such as air. The resulting mixture must then be supplied with sufficient heat and, if possible, free radicals, which are highly reactive chemical species such as H, OH and O, to ignite. Once ignition occurs, combustion is generally completed within a very short time period. After initial ignition, combustion proceeds via an internal feedback process that ignites the incoming reactants by bringing them into contact within the combustor with hot combustion products and, on occasion, with reactive gas pockets produced by previously injected reactants.

To maintain the flame in the combustor, it must be anchored in a region where the velocity of the incoming reactants flow is low. Low velocities, or long residence times, allow the reactants sufficient time to ignite. In the well known Bunsen burner, the flame is anchored near the burner's rim and the required feedback is accomplished by molecular conduction of heat and molecular diffusion of radicals from the flame into the approaching stream of reactants. In gas turbines, the flame anchoring and required feedback are typically accomplished by use of one or more swirlers that create recirculation regions of low velocities for anchoring the flame and back flow of hot combustion products and reacting pockets that ignites the incoming reactants. In ramjets and afterburners, this is accomplished by inserting bluff bodies, such as a V-shaped gutter, into the combustor to generate regions of low flow velocities and recirculation of hot combustion pockets and reacting gas pockets to anchor the flame and ignite the reactants.

More recently, in an effort to reduce NOx emissions in industrial processes, the use of high velocity fuel and air jets to attain what is referred to as flameless combustion has been advocated. U.S. Pat. No. 5,570,679 discloses a flameless combustion system. In the '679 patent, an impulse burner is disclosed. Fuel and air jets that are spatially separated by specified distances are injected into the combustor or process with high velocities. The system incorporates two separate operating states. In the first state, the burner is first switched such that a first fuel valve is opened and a second fuel valve is closed. The fuel and oxidant are mixed in an open combustion chamber and ignited with stable flame development and the flame gases emerge through an outlet opening in the combustion chamber to heat up the furnace chamber. As soon as the furnace chamber is heated to the ignition temperature of the fuel, a control unit switches the burner over to a second operating state by closing of the first fuel valve and opening a second fuel valve. In this second operating state, no fuel is introduced into the combustion chamber and as a consequence, the burning of the fuel in a flame in the combustion chamber is essentially suppressed entirely. The fuel is fed into the furnace chamber exclusively.

Because of their high momentum, the incoming fuel and oxidant jets act as pumps entraining large quantities of hot combustion products within the furnace chamber. Since the furnace chamber has been heated up to the ignition temperature of the fuel, the reaction of the fuel with the combustion oxidant takes place in a distributed combustion process along the vessel without a discernible flame. Consequently, this process has been referred to as flameless combustion or flameless oxidation. Since this process requires that the incoming reactants jets mix with large quantities of hot products, its combustion intensity, i.e., amount of fuel burned per unit volume per second, is low. Also, the system requires high flow velocity of the fuel jets to create the pump action necessary for mixing the fuel with the hot combustion products. Additionally, since a significant fraction of the large kinetic energy of the injected reactants jets is dissipated within the furnace, the process experiences large pressure losses. Consequently, in its current design, this process is not suitable for application to land-based gas turbines and aircraft engine's combustors and other processes which require high combustion intensity and/or low pressure losses.

In another combustion system, often referred to as well stirred or jet stirred combustor, fuel and oxidant are mixed upstream of the combustion chamber and the resulting combustible mixture is injected via one or more high velocity jets into a relatively small combustor volume. The high momentum of the incoming jets produces very fast mixing of the incoming reactants with the hot combustion products and burning gases within the combustor, resulting in a very rapid ignition and combustion of the reactants in a combustion process that is nearly uniformly distributed throughout the combustor volume.

Generally, existing combustion systems minimize NOx emissions by keeping the temperatures throughout the combustor volume as low as possible. A maximum target temperature is approximately 1800K, which is the threshold above which thermal NOx starts forming via the Zeldovich mechanism. Another requirement for minimizing NOx formation is that the residence time of the reacting species and combustion products in high temperature regions, where NOx is readily formed, be minimized. On the other hand, temperatures and the residence times of the reacting gases and hot combustion products inside these combustors must be high enough to completely burn the fuel and keep the emissions of CO, UHC, and soot below government limits.

Accordingly, there is a need to develop a simple combustion system which produces low NOx emissions while being adaptable to many operational environments.

The object of the invention is to create a simple and low cost combustion system that uses its geometrical configuration to attain complete combustion of fuels over a wide range of fuel flow rates, while generating low emissions of NOx, CO, UHC and soot.

Another object of the invented combustion system is to provide means for complete combustion of gaseous and liquid fuels when burned in premixed and non-premixed modes of combustion with comparable low emissions of NOx, CO, UHC and soot.

Another object of this invention is to provide capabilities for producing a robust combustion process that does not excite detrimental combustion instabilities in the combustion system when it burns liquid or gaseous fuels in premixed and non-premixed modes of combustion.

Another object of this invention is to use the geometrical arrangement of the combustion system to establish the feedback between incoming reactants and out flowing hot combustion products that ignites the reactants over a wide range of fuel flow rates while keeping emissions of NOx, CO, UHC and soot below mandated government limits.

SUMMARY OF THE INVENTION

A method for combusting reactants includes providing a vessel having an opening near a proximate end and a closed distal end defining a combustion chamber. A combustible reactants mixture is presented into the combustion chamber. The combustible reactants mixture is ignited creating a flame and combustion products. The closed end of the combustion chamber is utilized for directing combustion products toward the opening of the combustion chamber creating a reverse flow of combustion products within the combustion chamber. The reverse flow of combustion products is intermixed with the incoming flow of combustible reactants to maintain the flame.

BRIEF DESCRIPTION OF THE DRAWINGS

The methods and methods designed to carry out the invention will hereinafter be described, together with other features thereof.

The invention will be more readily understood from a reading of the following specification and by reference to the accompanying drawings forming a part thereof.

DESCRIPTION OF THE PREFERRED EMBODIMENT

Referring now in more detail to the drawings, the invention will now be described in more detail.

Figure 1A:
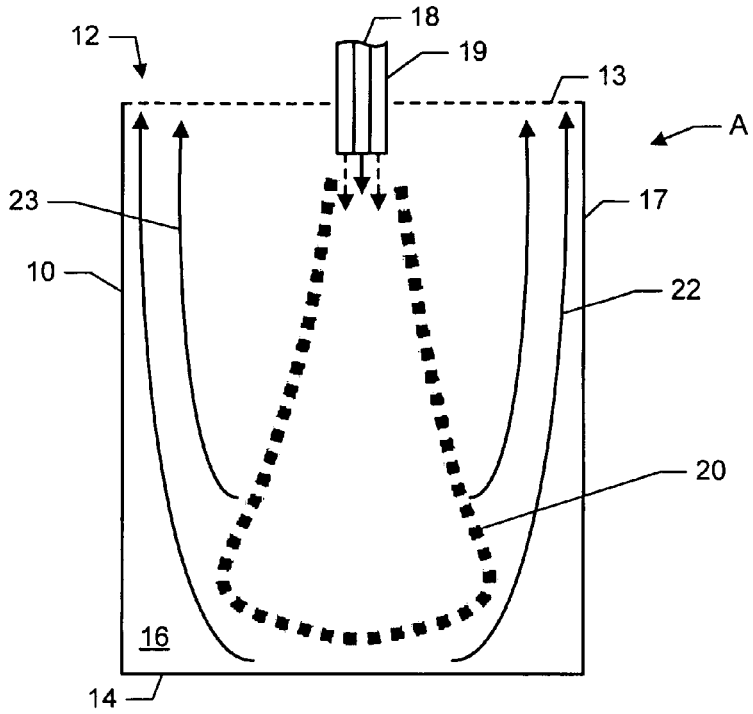
FIG. 1A illustrates a prospective view of a combustion system and method utilizing a non-premix fuel supply according to the present invention.

As shown in FIG. 1A, a system and method of combusting are disclosed. Combustion system A includes a vessel 10 which has a proximate end 12 and a distal closed end 14 defining a combustion chamber 16. Proximate end 12 may define opening 13. Also, opening 13 may be located near proximate end 12 in either sidewall 17. A fuel supply 18 and oxidant supply 19 are provided into the combustion chamber for combustion. An igniter (not shown) ignites the reactants creating a flame 20 and combustion products 22. Due to the geometry of combustion chamber 16, the incoming reactants flow, which initially flows toward the distal closed end, is reversed and the combustion products flow 22 and 23 exit via opening 13.

Figure 2A:
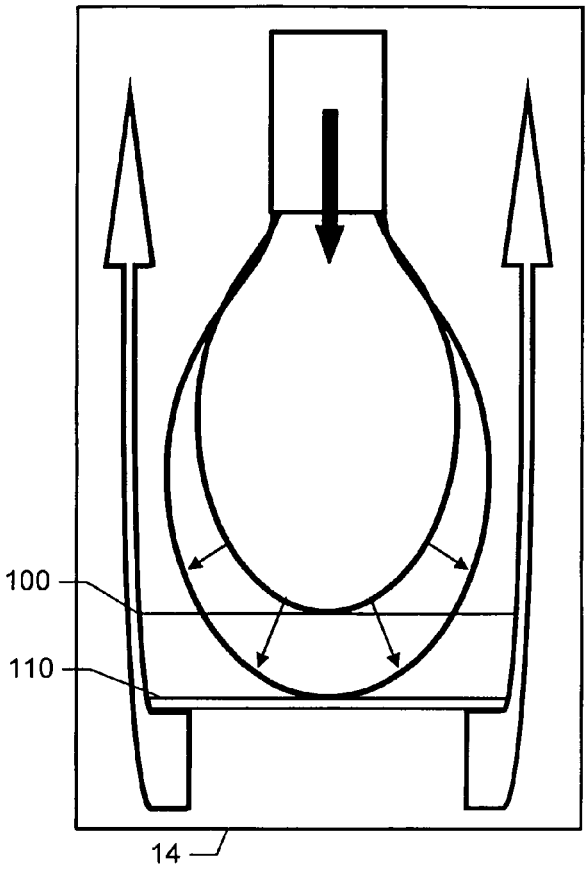
FIG. 2A illustrates the flame shapes at two operating conditions at two predetermined flow rates of reactants according to the present invention.
Figure 2B:
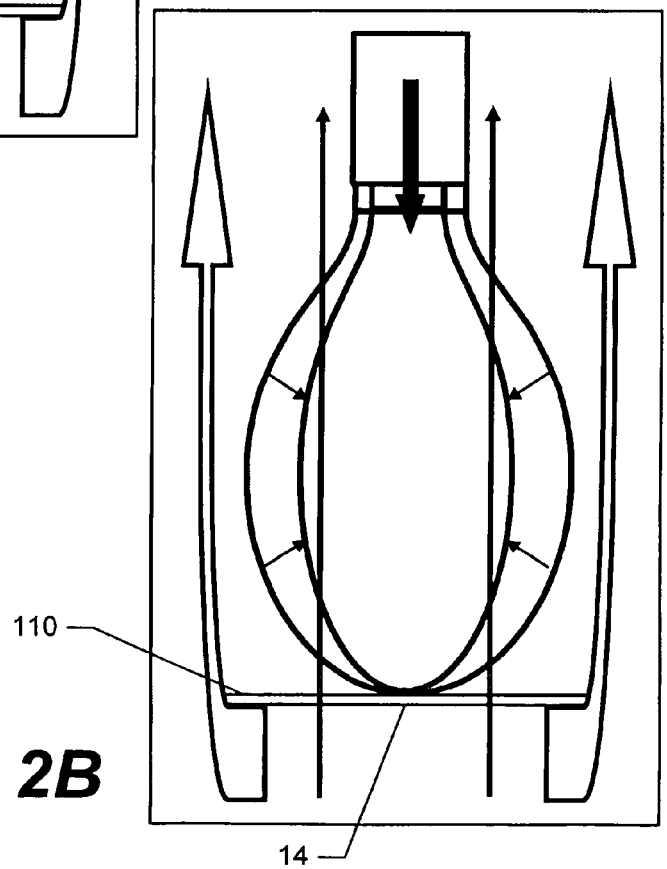
FIG. 2B illustrates the flame shapes at two operating conditions at two different fuel-air ratios of the present invention.

FIGS. 2A and 2B illustrate the adaptability of the combustion system A. As shown in FIG. 2A, different flame tip locations may be established within the stagnation zone utilizing the combustion chamber design having a distal closed wall and sidewalls when operated with different reactants flow rates. For a first operating condition having a predetermined flow rate, a flame tip location 100 may be realized for stabilizing the flame. For another operating condition utilizing a higher flow rate of reactants, the flame tip is located at location 110 which is closer to the combustion chamber end wall than for the lower flow rate reactants. As FIG. 2A illustrates, the tip of the flame within the combustion chamber occurs within the stagnation zone near the distal end wall where the velocity of the incoming reactants flow is low. As shown in FIG. 2*b*, the shape of the stabilized flame varies as the equivalence ratio of the reactants changes and a stable flame is attained at different reactants equivalence ratios.

The stagnation zone acts to produce the low velocity, long residence time conditions that are conducive to stabilizing the flame under a wide range of fuel flow rates and equivalence ratios. Thus, even at high inlet velocities, the stagnation region is distinguished by low local velocities. Similarly the flame remains stable even for very low equivalence ratios, as identified by symbol $\phi$ phi. To one skilled in the art, the definition of equivalence ratio is as follows: actual fuel-air mass ratio divided by the stoichiometric fuel-air mass ratio.

As shown in FIG. 1A, one embodiment of the system is for a non-premixed combustion system. In a non-premixed combustion system, reactant and oxidant are provided separately into the combustion chamber and mixed within the combustion chamber. In the preferred embodiment, a fuel jet 18 provides fuel via a central stream. Adjacent the central fuel jet is an oxidant jet 19. In the preferred embodiment, oxidant jet 19 is annular which surrounds the central fuel jet. However, various oxidant jet configurations may be had which provide for a flow of oxidant to encircle the fuel flow. The fuel reactants and oxidant are mixed within the combustion chamber to provide a combustible reactants mixture. As shown in FIG. 1A, the jets have their outlets aligned to prevent any premixing and are preferably are axially aligned with vessel 10. These jets may be located within the combustion chamber or in a close proximity outside of the combustion chamber. The combustible reactants mixture is capable of being injected into the combustion chamber at different rates via a nozzle, and the combustion process may have a turndown ratio of at least 1.5 and can be greater.

Figure 1B:
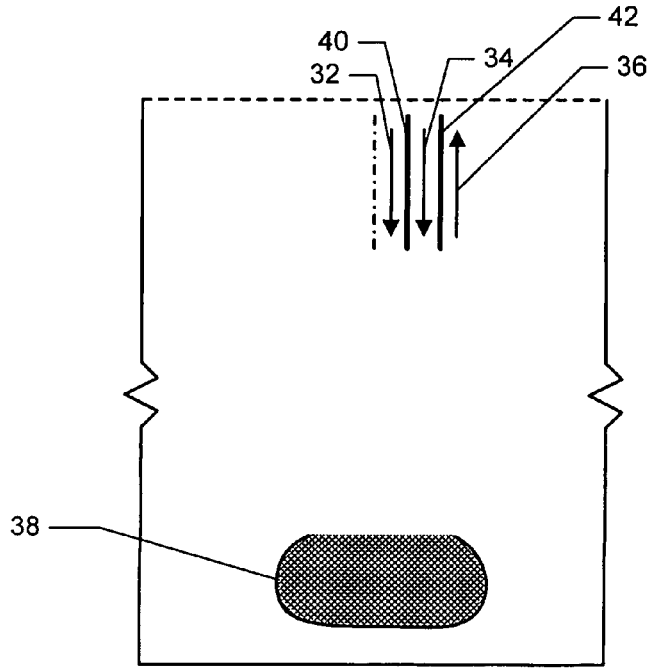
FIG. 1B illustrates a schematic of fluid flows within the system and method shown in FIG. 1A.

As shown in FIG. 1B, the separate fuel and oxidant flows interact within the combustion chamber. As fuel flow 32 flows toward the end wall of the combustion chamber, it interacts with oxidant flow 34, which is also flowing toward the end wall of the combustion chamber. The interaction of the fuel and oxidant flows creates an inner shear layer 40. While this is occurring, combustion products and burning gas pockets flow 36 is flowing toward the open end of the combustion chamber away from the distal end of the combustion chamber. The combustion product and burning gas pockets flow 36 is simultaneously interacting with the downward oxidant flow 34 creating a second, outer shear layer 42. The oncoming reactants flows are also slowed down as they approach the closed end wall of the combustion chamber, producing a stagnation flow zone 38 near the end wall. In the preferred embodiment, it is desired that stagnation zone 38 be located at least below the mid point of the combustion chamber in order to provide for a vessel which is of the smallest dimensions possible in both size and weight.

To one skilled in the art, shear layers are created when velocities between the respective entities are different. For instance, as shown in FIG. 1B, the different velocities between the fuel and oxidants create a first shear layer, and the different velocities between the oxidants and combustion products and radicals create a second shear layer. This is also shown in FIG. 3B wherein a shear layer is shown between the premixed reactants and the combustion products and radicals. A critical feature of the invention is that the shear layers between the reactants and combustion products and radicals, element 42 in FIG. 1B and element 54 in FIG. 3B, exist because of opposite counter flowing streams which are parallel to one another. Most preferably these flows are along the axis of the combustor and consequently parallel to the axis of the combustor. These shear layers exist in the vicinity of the entry of the reactants into the vessel's combustion chamber. Hence, it is the geometry of the combustion chamber which enables the elements to be counter flowing adjacent and parallel to each other sufficiently creating a shear layer which is essential to the invention.

In the outer shear layer 42, the oxidant mixes with the hot products and in the inner shear layer, the oxidant mixes with the fuel. Since the outer shear layer is located between two counter flowing streams, the mixing inside this shear layer is much more intense than the mixing within the inner shear layer that involves mixing between fuel and oxidant streams that move in the same direction. The resulting streams of fuel-oxidant and oxidant-hot combustion products and burning gas pockets that form in the inner and outer shear layers, respectively, come into contact and burn in a manner similar to a premixed mode of combustion, which produces low NOx emissions when the equivalence ratio of the reactants mixture is low. Thus, this mixing between the incoming reactants and out flowing hot products and reacting gas pockets establishes the feedback of heat and radicals needed to attain ignition over a wide range of fuel flow rates. Since the presence of radicals in a mixture of reactants lowers its ignition temperature, some of the fuel ignites and burns at lower than normal temperatures, which can lead to a reduced amount of NOx generated in this combustion system.

The intensity of mixing in the shear layers between the incoming reactants and out flowing hot combustion products and burning gas pockets generally controls the ignition and rate of consumption of the fuel. Specifically, an increase in the mixing intensity within these shear layers accelerates ignition and the rate of consumption of the fuel. Since in this invention the velocities of the co- and counter-flowing streams on both sides of the shear layers increase as the fuel supply rate to the combustion chamber increases, the intensity of the mixing rates inside the shear layers increases as more reactants are burned inside the combustor, thus accelerating the ignition and combustion of the reactants. Consequently, since the rates of the processes that consume the reactants automatically increase in this invention as the reactants injection rates into the combustion chamber increase, the invented combustion system can operate effectively over a wide range of reactants supply rates, and thus power levels. It also follows that the invented combustion chamber can burn reactants efficiently at rates needed for a wide range of applications, including land based gas turbines, aircraft engines, water and space heaters, and energy intensive industrial processes such as aluminum melting and drying.

In the embodiment of FIG. 1A, as the hot gases leave the combustion chamber, they move around the pipes that supply the cold reactants into the combustor. This contact transfers heat from the hot combustion products into the reactants stream, thus increasing the temperature of the reactants prior to their injection into the combustor. This, in turn, reduces the time required to burn the fuel or allows the combustion of leaner mixtures.

Figure 3A:
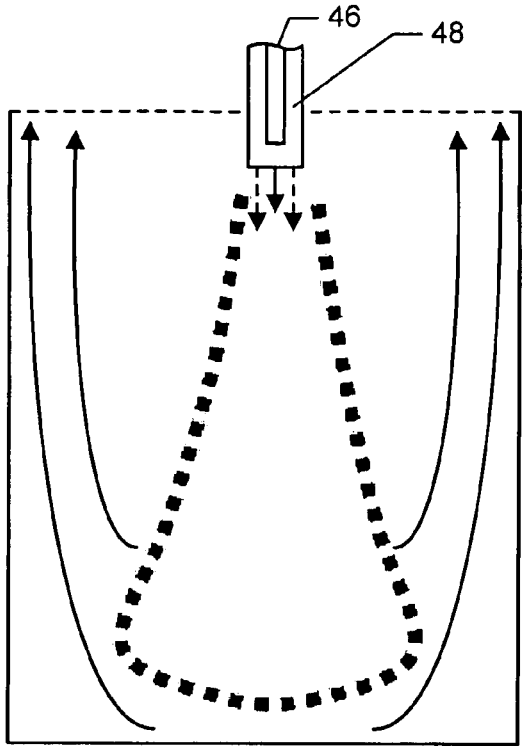
FIG. 3A illustrates a prospective view of a combustion system and method utilizing a premixed fuel supply according to the present invention.
Figure 3B:
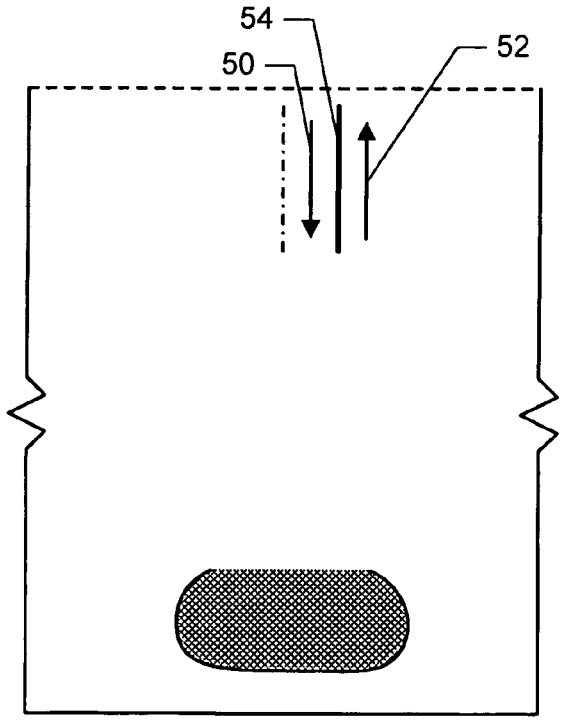
FIG. 3B illustrates a schematic of fluid flows within the system and method shown in FIG. 3A.

FIGS. 3A and 3B illustrate the operation of the combustion invention in a premixed combustion mode. As shown in FIG. 3A, the system is generally the same as that for the non premixed system described with respect to FIG. 1A, except that the fuel jet 46 is positioned to provide for the fuel to mix with the oxidant flow 48 prior to entering into the combustion chamber. As shown in FIG. 3B, the premixed reactants flow 50 interacts with counter flowing combustion products flow 52 to establish only one shear layer 54 between the counter flowing streams. The injected combustible mixture is ignited in the shear layer 54 at its outer boundary where it mixes with hot combustion products and radicals supplied by the stream of gases flowing in the opposite direction out of the combustion chamber. As the flow of reactants decelerates as it approaches the closed end of the combustion chamber, the rate of mixing between the reactants and hot products and reacting gas pockets is increased by the formation of vortices in the flow. This, in turn, causes a larger fraction of reactants to ignite and burn as the flow approaches the closed end of the combustion chamber.

The invented combustion system can also burn liquid fuels in premixed and non premixed modes of combustion. When burned in a premixed mode, the liquid fuel is first prevaporized and then premixed with the oxidant to form a combustible mixture that is then injected into the combustion chamber. The resulting mixture is then burned in a manner similar to that in which a combustible gaseous fuel-oxidant mixture is burned in a premixed mode, as described in the above paragraphs. When the liquid fuel is burned in a non premixed mode, the fuel is injected separately into the combustor through an orifice aligned with the axis of the combustion chamber and the combustion oxidant is injected in through an annular orifice surrounding the fuel orifice in the manner similar to that used to burn gaseous fuel in a non premixed mode, as described above. As in the non premixed gaseous fuel combustion case, the oxidant stream is confined within two shear layer at its inside and outside boundaries. In the inside shear layer, the oxidant mixes with the injected liquid fuel stream. In the process, liquid fuel is entrained into the shear layer where it is heated by the air stream. This heating evaporates the liquid fuel and generates fuel vapor that mixes with the oxidant to form a combustible mixture. In the outer shear layer, the oxidant mixes with the counter flowing stream of hot combustion products and reacting gas pockets. The resulting fuel-oxidant mixture that is formed in the inner shear layer is ignited and burned in essentially premixed mode of combustion when it comes into contact with the mixture of oxidant-hot combustion products-reacting gas pockets mixture that formed in the outer shear layer.

As shown in FIGS. 1A and 3A, the fuel and oxidant injectors are adjacent to one another forming an injector assembly. For the non-premixed assembly shown in FIG. 1A, the outlet of the respective injectors where the fuel and oxidant enter into the combustion vessel is most preferably located within the combustion vessel past the plane defined by the opening in the proximate end. For the pre-mixed assembly shown in FIG. 3A, the mixed combustion reactants of fuel and oxidant are presented to the combustion chamber past the plane defined by the opening in the proximate end. Additionally, the area adjacent the injectors near the point where the combustible reactants enter into the combustion vessel is unobstructed. Preferably the opening of the vessel is adjacent the injectors such that an unobstructed flow of combustion reactants is presented adjacent the injectors' outlets where the combustible reactants enter into the combustion vessel through the plane created by the vessel's opening.

Figure 4:
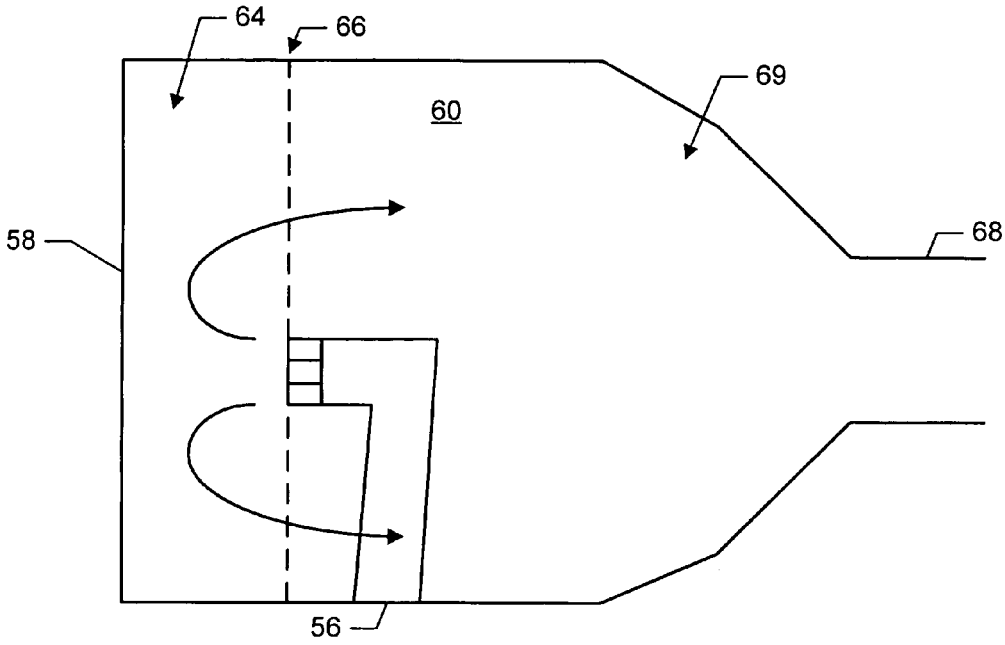
FIG. 4 illustrates a prospective view of a combustion method according to the present invention utilized in a jet engine.

FIG. 4 illustrates a utilization of the combustion system when applied to a jet engine. Fuel and oxidant are provided via source 56 and directed toward the closed end wall 58 of combustion chamber 60. The combustion products generated in the flame region in the stagnation zone 64 near the closed end wall 58, are forced by the closed wall 58 to reverse flow direction and move towards the combustor exhaust outlet 66. As shown in this embodiment, the combustor exhaust outlet 66 is defined as the point within the overall vessel which is proximate to the inlet position of the reactants 56. Hence, as shown in this embodiment, the combustion chamber itself may be part of a larger vessel. In the example as shown, the combustor is connected to a transition section 69 with an exhaust nozzle 68 which enables the combustion products to exit the combustor. This exit is to be distinguished from the combustion exhaust outlet 66 as utilized herein.

Figure 5A:
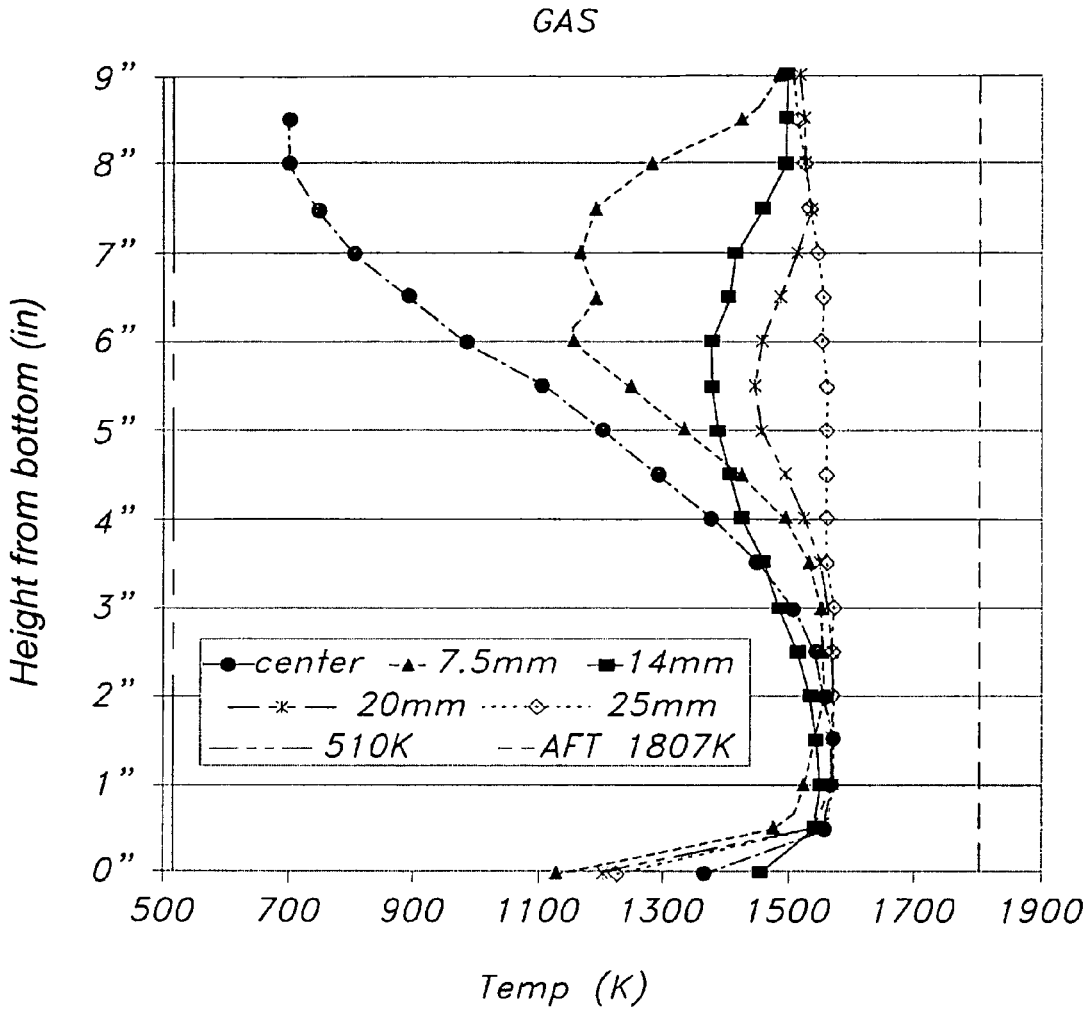
FIG. 5A illustrates measured vertical temperature distributions at different radial locations arising from a gaseous fuel combustion shown in FIG. 3A.
Figure 5B:
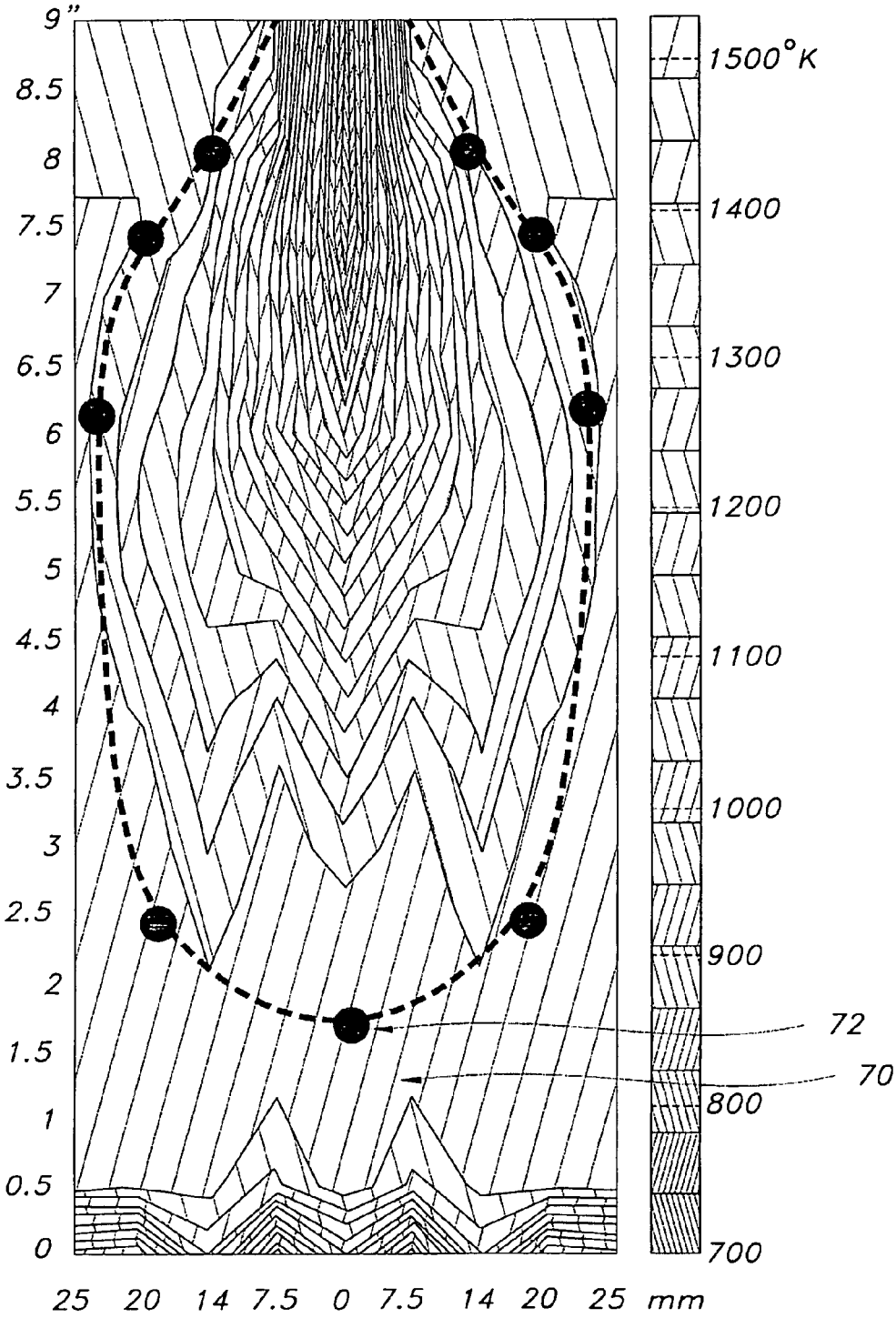
FIG. 5B illustrates measured vertical temperature distribution within the combustor obtained from the presented gaseous fuel when burning in FIG. 5A.
Figure 6A:
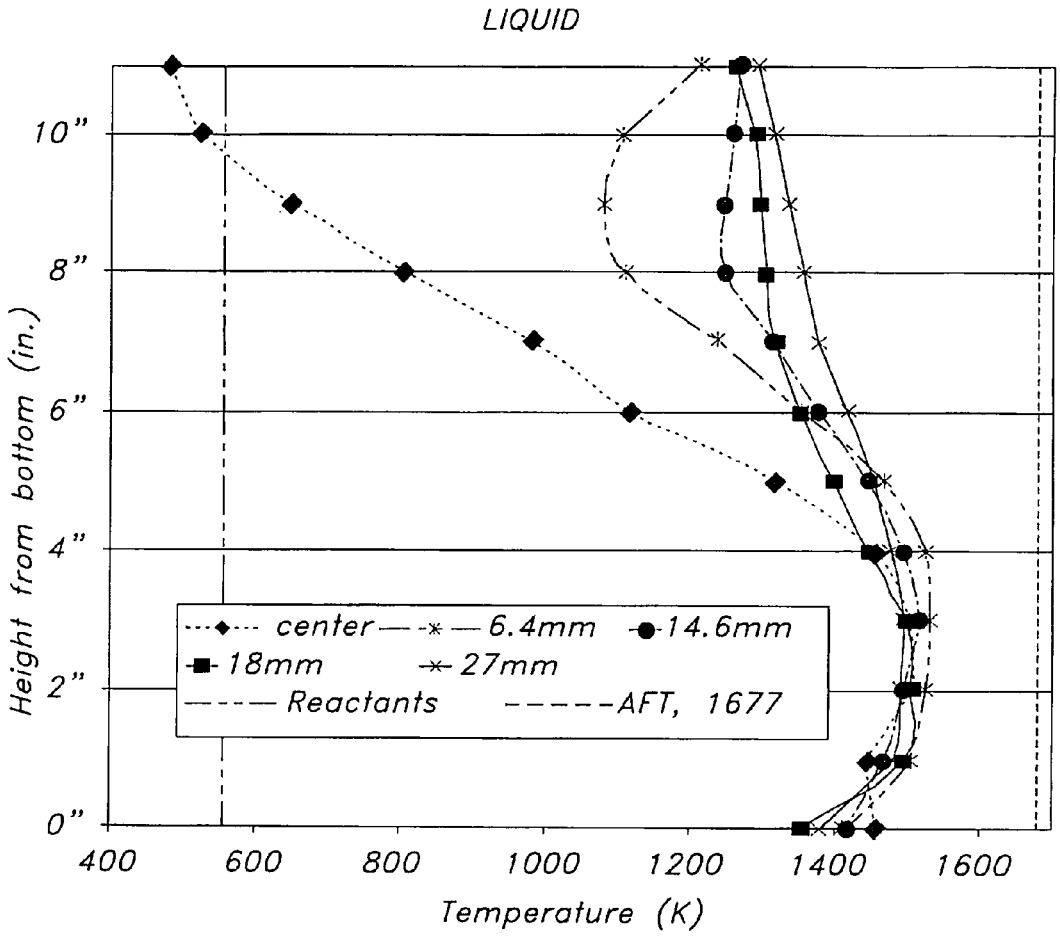
FIG. 6A illustrates measured vertical temperature distribution at different radial locations arising from a liquid fuel combustion shown in FIG. 1A.
Figure 6B:
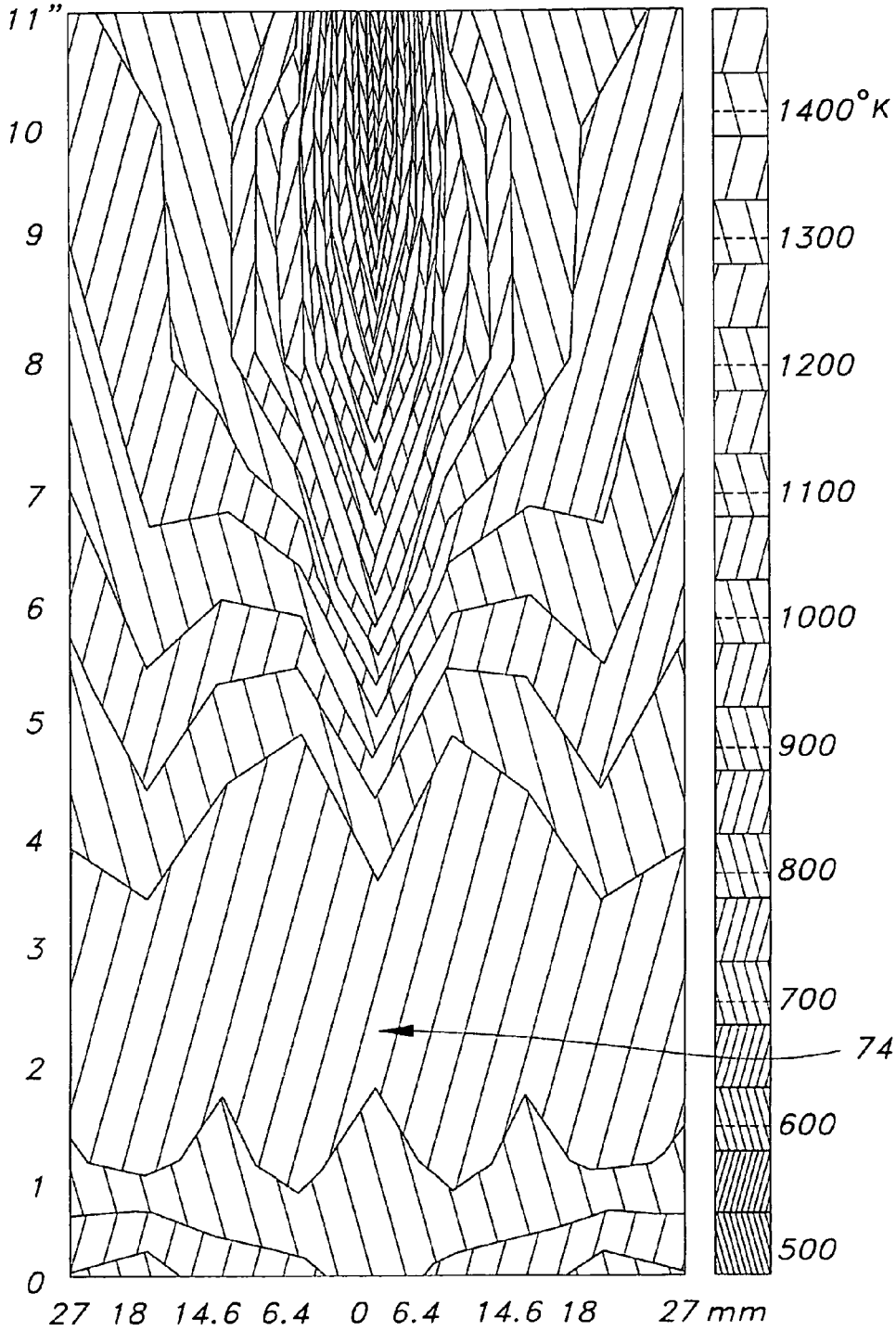
FIG. 6B illustrates measured vertical temperature distribution within the combustor obtained from the data in FIG. 6A.

FIGS. 5 and 6 illustrate examples of measured average temperature distributions within the present invention. FIG. 5 shows the shape of a flame created when gaseous fuel was burned in the present invention. A key feature of the present invention is the elimination of high temperature regions within the combustion chamber. By eliminating such high temperature regions, NOx emissions are minimized. As shown in FIG. 5, the flame is approximately stabilized in a location within stagnation zone 70. Also, the average temperatures within the invented combustor are generally below 1800 degrees K. Since the invented combustion systems essentially burns gaseous and liquid fuels in a premixed mode of combustion, even if the fuel and oxidant are injected separately into the combustion chamber, the temperature of the resulting flame can be kept below the threshold value of 1800K that produces NOx by controlling the amounts of oxidant and fuel supplied into the combustion chamber. When the overall air-fuel ratio is high, the resulting flame temperature is low, resulting in low NOx emissions.

FIG. 6 shows the average temperature distribution within the invented combustor for a particular example when burning a liquid fuel at an equivalence ratio of 0.48 and injected air velocity of 112 m/s. A stagnation zone between 74 and the wall was established providing a low velocity region near the distal wall where the flame is stably anchored around line 74. Again, no high temperature regions are evident.

Figure 7:
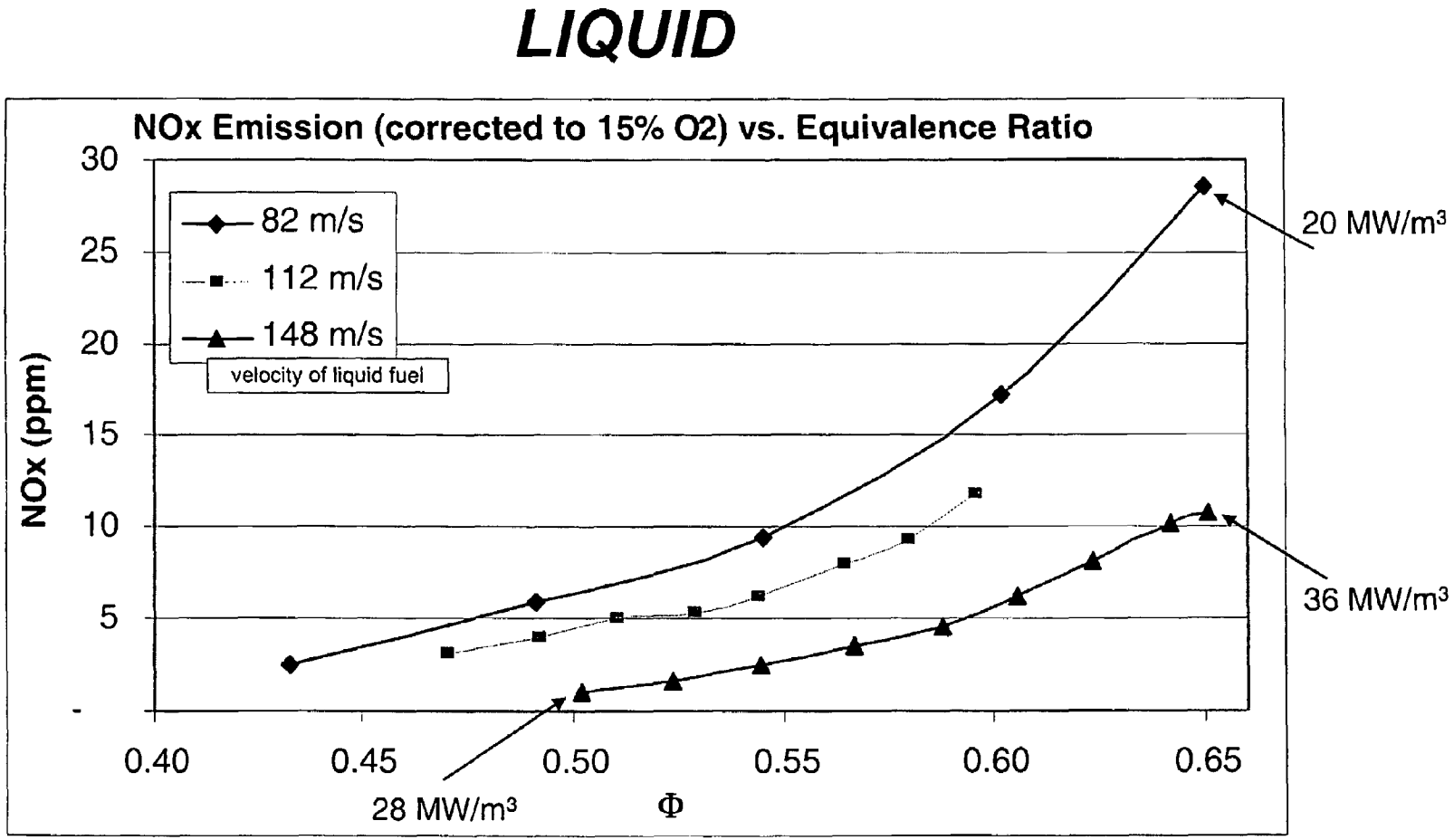
FIG. 7 illustrates $NO_x$ emissions corrected to 15% $0_2$ versus equivalence ratios when burning a liquid fuel at various air injection velocities yielding various power densities of the present invention.

FIG. 7 illustrates the dependence of the NOx emissions within the combustion chamber shown in FIG. 1, when burning heptane liquid fuel in a non premixed mode of combustion, upon the injection air velocity and global equivalence ratio. As shown by the chart, the power density of the system increased as the equivalence ratio increased and the velocity of the oxidant increased. This chart illustrates that depending on the ultimate utilization of the combustion system of FIG. 1, NOx emissions as low as 1 part per million could be obtained with good power density or if more power or slower flow rates were desired the NOx emissions could still be maintained at low levels without changing the combustor size.

Figure 8:
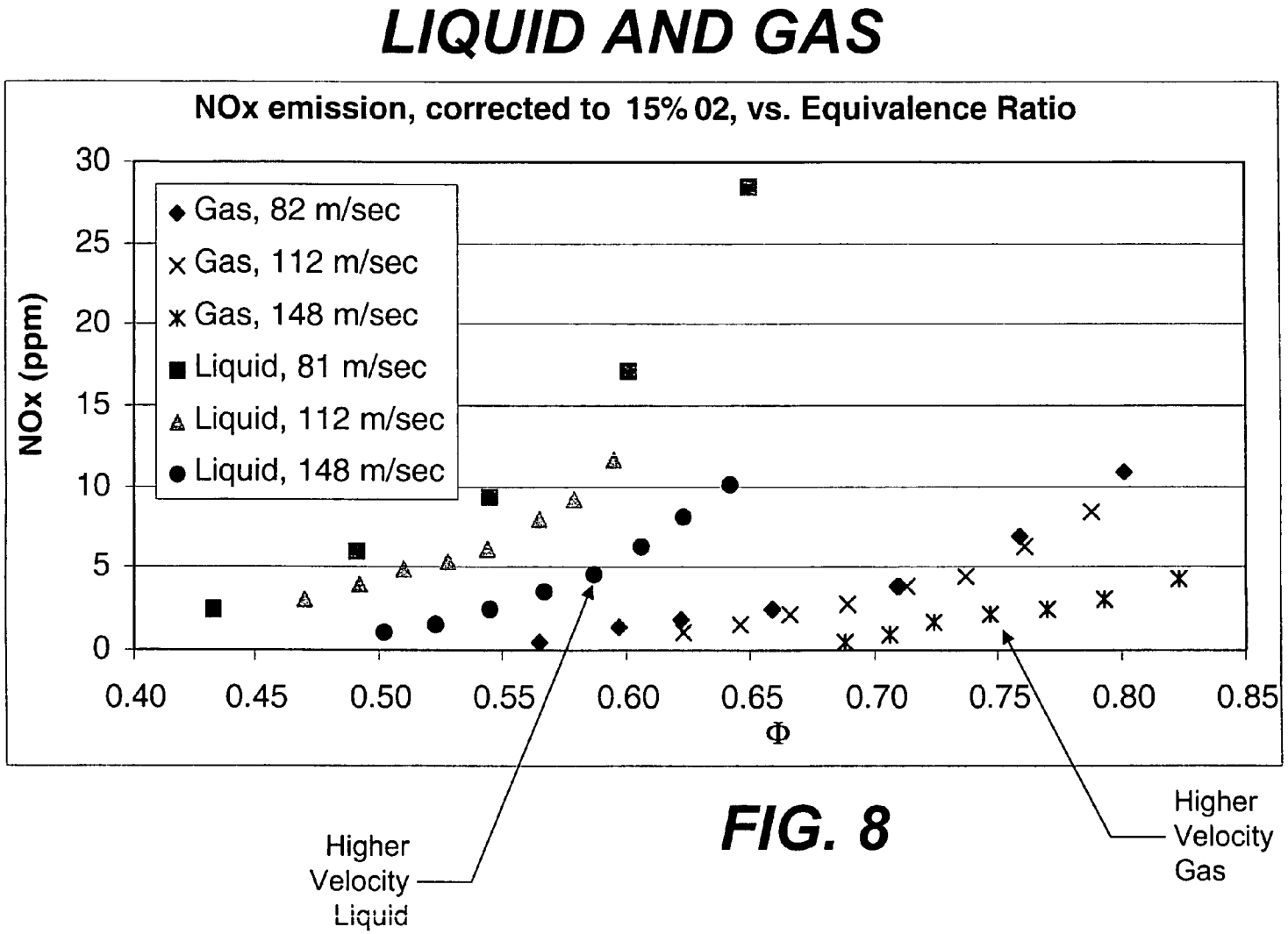
FIG. 8 illustrates $NO_x$ emissions of some examples of the present invention when burning gaseous and liquid fuels with various reactants' injection velocities and different equivalence ratios.
Figure 9:
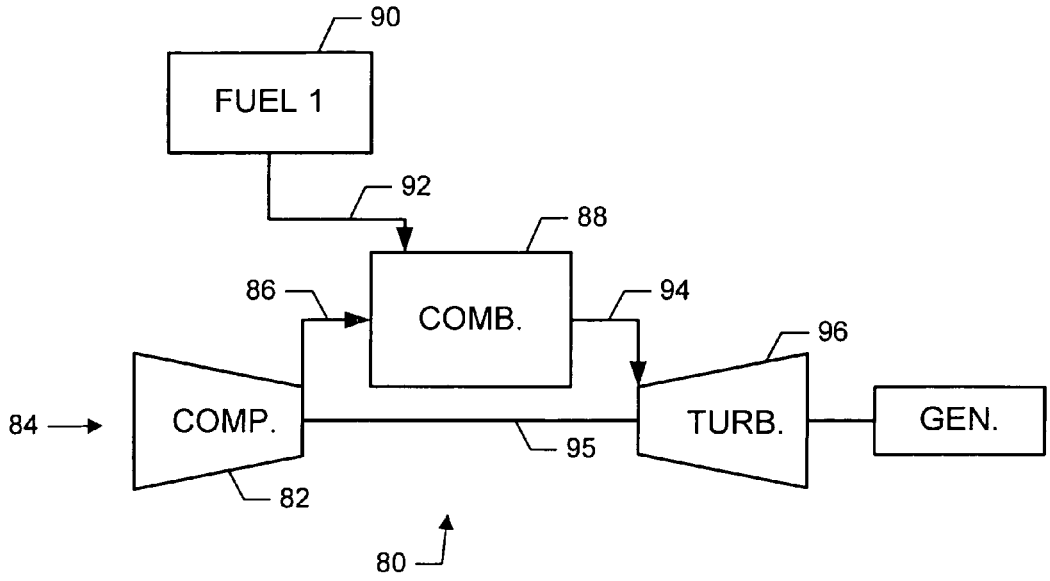

FIG. 8 illustrates the results of multiple tests conducted utilizing the combustion system shown in FIGS. 1 and 3. The combustion system produced extremely low NOx emissions while burning gaseous and liquid over a wide range of gaseous and liquid fuel flow rates and equivalence ratios. Furthermore, since in this invention the generated fuel-air mixture is mixed with hot combustion products and radicals, such as O, OH and H, the combustor can be operated at low equivalence ratios, and thus low temperatures, reducing NOx emissions. In fact, FIGS. 7 and 8 illustrate that tests with the invented combustion system produced NOx emissions as low as 1 ppm at 15% $O_2$ when burning gases and liquid fuels in premixed and non premixed modes of combustion.

In operation as previously described, a method for combusting a fuel includes providing a vessel having an opened proximate end and a closed distal end defining a combustion chamber. A fuel and oxidant are presented into the combustion chamber. The fuel is ignited creating a flame and combustion products. The closed end of the combustion chamber is utilized for slowing the approaching flow, creating a stagnation region, and for redirecting combustion products toward the open end of the combustion chamber, thus creating a reverse flow of combustion products within the combustion chamber. The reverse flow of combustion products is intermixed with the oncoming reactants maintaining the flame. The utilization of a reverse flow of combustion products within the combustion chamber and the creation of a stagnation zone maintain a stable flame, even at low temperatures. In operation a power density of 100 $MW/m^3$ has been achieved.

The advantages provided by the combustion system are capabilities to burn gaseous and liquid fuels with an oxidant in either premixed or non-premixed modes of combustion with high combustion efficiency, low NOx emissions and high power densities.

The advantages of the combustion system provides for a powerful, low NOx system which can be utilized to burn gaseous and liquid fuels in either premixed or non-premixed mode with oxidants.

What is claimed is:

1. A method of combusting reactants including a fuel and an oxidizer, comprising the actions of:

a. directing the reactants from a nozzle into a combustion chamber so that a fuel flow is surrounded and shielded by a concentric oxidizer flow;

b. igniting the reactants to initiate combustion in the combustion chamber, thereby generating a flame and combustion products;

c. reducing velocity of the reactants inside the combustion chamber so as to anchor part of the flame relative to the combustion chamber adjacent to a stagnation zone;

d. mixing a portion of combustion products with the oxidizer flow in a non-combusted portion of the reactants between the nozzle and the flame by redirecting the combustion products so as to flow coaxially outside of the oxidizer flow, in a direction counter thereto, so that the combustion products come in contact with the oxidizer flow, thereby forming a shear layer between the combustion products and the oxidizer flow and so that combustion products mix with the oxidizer flow in the shear layer, thereby maintaining combustion of the reactants at a temperature that is lower than would be obtained if the portion of the combustion products were not mixed with the oxidizer flow; and e. exhausting the combustion products coaxially about the reactants flowing into the combustion chamber in a direction that is opposite to the reactants flowing into the combustion chamber.

2. The method of claim 1, further comprising the action of preheating the reactants by directing hot gasses leaving the combustion chamber about at least one pipe supplying the reactants to the nozzle.

3. The method of claim 1, further comprising the action of maintaining flow rates of the reactants so that combustion mostly occurs at a temperature that is less than 1750K.

4. An apparatus for combusting reactants including a fuel and an oxidizer, which have been ignited so as to generate a flame and create combustion products, the apparatus comprising:

a. a combustion chamber having an open proximal end and an opposite distal end, an end wall disposed at the distal end, the combustion chamber configured so that the combustion products are exhausted coaxially about the reactants flowing into the combustion chamber in a direction that is opposite to the reactants flowing into the combustion chamber; and b. a nozzle that is configured to direct a fuel flow and an oxidizer flow into the combustion chamber so that the oxidizer flow shields the fuel flow, the end wall of the combustion chamber being configured to reduce a velocity of the reactants inside the combustion chamber so as to anchor part of the flame relative to the combustion chamber adjacent to a stagnation zone and to redirect the combustion products so as to flow coaxially outside of the fuel flow and the oxidizer flow, in a direction counter thereto, so that the combustion products come in contact with a non-combusted portion of the fuel flow and the oxidizer flow, thereby forming a shear layer between the combustion products and the non-combusted portion and so that a portion of the combustion products mix with the oxidizer in the shear layer, thereby maintaining combustion of the reactants at a temperature that is lower than would be obtained if the portion of the combustion products were not mixed with the oxidizer in the shear layer.

5. The apparatus of claim 4, wherein the proximal end of the combustion chamber is configured to direct hot gasses leaving the combustion chamber about at least one pipe supplying the reactants to the nozzle thereby preheating the reactants.

6. The apparatus of claim 4, wherein the nozzle is configured to maintain a flow rate of the reactants so that combustion mostly occurs at a temperature that is less than 1750K.

7. A method of combusting reactants including a fuel and an oxidizer, comprising the actions of:

a. premixing the reactants so as to generate premixed reactants;

b. directing the premixed reactants from a nozzle into a combustion chamber, thereby generating an incoming reactant flow;

c. igniting the reactants to initiate combustion in the combustion chamber, thereby generating a flame and combustion products;

d. reducing velocity of the reactants inside the combustion chamber so as to anchor part of the flame relative to the combustion chamber adjacent to a stagnation zone;

e. mixing a portion of combustion products with a non-combusted portion of the incoming reactant flow by redirecting the combustion products so as to flow coaxially outside of the reactant flow, in a direction counter thereto, so that the combustion products come in contact with the non-combusted portion, thereby forming a shear layer between the combustion products and the non-combusted portion and so that combustion products mix with the non-combusted portion of the incoming reactant flow in the shear layer, thereby maintaining combustion of the reactants at a temperature that is lower than would be obtained if the portion of the combustion products were not mixed with the oxidizer flow; and f. exhausting the combustion products coaxially about the reactants flowing into the combustion chamber in a direction that is opposite to the reactants flowing into the combustion chamber.

8. The method of claim 7, further comprising the action of preheating the reactants by directing hot gasses leaving the combustion chamber about at least one pipe supplying the reactants to the nozzle.

9. The method of claim 7, further comprising the action of maintaining flow rates of the reactants so that combustion mostly occurs at a temperature that is less than 1750K.

10. An apparatus for combusting reactants including a fuel and an oxidizer, which have been ignited so as to generate a flame and create combustion products, the apparatus comprising:

a. a combustion chamber having an open proximal end and an opposite distal end, an end wall disposed at the distal end, the combustion chamber configured so that the combustion products are exhausted coaxially about the reactants flowing into the combustion chamber in a direction that is opposite to the reactants flowing into the combustion chamber; and b. a nozzle that is configured to premix the reactants and to direct the reactants into the combustion chamber, thereby generating in incoming reactants flow, the end wall of the combustion chamber being configured to reduce a velocity of the reactants inside the combustion chamber so as to anchor part of the flame relative to the combustion chamber adjacent to a stagnation zone and to redirect the combustion products so as to flow coaxially outside of the reactant flow, in a direction counter thereto, so that the combustion products come in contact with a non-combusted portion of the reactant flow, thereby forming a shear layer between the combustion products and the non-combusted portion and so that combustion products mix with the non-combusted portion of the incoming reactant flow in the shear layer, thereby maintaining combustion of the reactants at a temperature that is lower than would be obtained if the portion of the combustion products were not mixed with the oxidizer flow.

11. The apparatus of claim 10, wherein the proximal end of the combustion chamber is configured to direct hot gasses leaving the combustion chamber about at least one pipe supplying the reactants to the nozzle thereby preheating the reactants.

12. The apparatus of claim 10, wherein the nozzle is configured to maintain a flow rate of the reactants so that combustion mostly occurs at a temperature that is less than 1750K.

* * * * *